US007748176B2

(12) United States Patent
Harding et al.

(10) Patent No.: US 7,748,176 B2
(45) Date of Patent: Jul. 6, 2010

(54) FLOORING SYSTEMS

(75) Inventors: Miceal John Peter Harding, Duffield (GB); Oliver Charles Harding, Belper (GB); Iain Mackenzie Macleod, Quarndon (GB)

(73) Assignee: Floor 2 Wall Limited, Uttoxeter (GB)

( * ) Notice: Subject to any disclaimer, the term of this patent is extended or adjusted under 35 U.S.C. 154(b) by 904 days.

(21) Appl. No.: 10/545,367

(22) PCT Filed: Feb. 12, 2004

(86) PCT No.: PCT/GB2004/000551

§ 371 (c)(1),
(2), (4) Date: Aug. 11, 2005

(87) PCT Pub. No.: WO2004/072406

PCT Pub. Date: Aug. 26, 2004

(65) Prior Publication Data

US 2006/0080909 A1 Apr. 20, 2006

(30) Foreign Application Priority Data

Feb. 12, 2003 (GB) ..... 0303136.6

(51) Int. Cl.
*E04B 5/02* (2006.01)
*E04C 3/00* (2006.01)

(52) U.S. Cl. ..... 52/177; 52/483.1; 52/592.1; 52/591.4; 52/574

(58) Field of Classification Search ..... 52/177, 52/309.1, 314, 483.1, 578, 580, 581, 604, 52/605, 745.05, 745.06, 745.13, 747.1, 764, 52/765, 775, 780, 650.3, 590.1, 590.2, 536, 52/592.1, 591.4, 574; D25/125
See application file for complete search history.

(56) References Cited

U.S. PATENT DOCUMENTS

| | | | | | |
|---|---|---|---|---|---|
| 3,110,371 | A * | 11/1963 | De Ridder | 52/588.1 |
| 3,385,182 | A * | 5/1968 | Harvey | 404/35 |
| 3,959,830 | A * | 6/1976 | van den Broek | 52/287.1 |
| 5,050,362 | A * | 9/1991 | Tal et al. | 52/588.1 |
| D366,943 | S * | 2/1996 | Sheehy | D25/138 |
| 5,636,481 | A * | 6/1997 | De Zen | 52/95 |
| 5,797,237 | A * | 8/1998 | Finkell, Jr. | 52/589.1 |
| 5,836,128 | A * | 11/1998 | Groh et al. | 52/580 |
| 6,295,778 | B1 * | 10/2001 | Burt | 52/592.6 |
| 6,324,796 | B1 | 12/2001 | Heath | |
| D485,621 | S * | 1/2004 | Deel | D25/119 |
| 6,729,097 | B2 * | 5/2004 | Patel et al. | 52/665 |
| 6,739,106 | B2 * | 5/2004 | Curatolo | 52/592.1 |
| 6,931,803 | B1 * | 8/2005 | Davis et al. | 52/251 |
| 7,047,697 | B1 * | 5/2006 | Heath | 52/177 |
| 2003/0019171 | A1 * | 1/2003 | Thibault et al. | 52/177 |

* cited by examiner

FOREIGN PATENT DOCUMENTS

| | | |
|---|---|---|
| BE | 557 844 A | 3/1960 |
| CH | 399 702 A | 9/1965 |

*Primary Examiner*—Richard E Chilcot, Jr.
*Assistant Examiner*—Chi Q Nguyen
(74) *Attorney, Agent, or Firm*—Bishop & Diehl, Ltd.

(57) ABSTRACT

A flooring system comprising a plurality of elongate members (1) secured together along adjacent longitudinal side edges by means of co-operating male and female formations (2, 3). The female formation (3) is a channel with relatively convergent sidewalls and the male formation comprises a hollow rail of complementary shape. An outer sidewall of the channel is resilient to allow the rail to be snapped into the channel in a direction transverse to the length of the members (1) and to return to its original shape to resist removal of the rail. The formations (2, 3) are arranged so that upper surfaces of adjacent members (1) form a panel having a planar support surface (21) and relative rotation of the members (1) about an axis parallel to the longitudinal side edges is resisted. Two panels may be joined together to provide upper and lower planar support surfaces (21, 22).

16 Claims, 10 Drawing Sheets

FLOORING SYSTEMS

CROSS-REFERENCE TO RELATED APPLICATIONS

This application claims priority from PCT Application No. PCT/GB2004/000551, filed 12Feb. 2004 (incorporated by reference herein) and British Application No. 0303106.6, filed 12 Feb. 2003 (incorporated by reference hererin).

TECHNICAL FIELD

This invention concerns improvements in or relating to flooring systems. The invention has particular, but not exclusive, application to flooring systems that can be assembled from a plurality of similar members releasably connected together.

BACKGROUND OF THE INVENTION

Flooring systems are known comprising a plurality of plastic members that can be releasably joined together to form a support surface suitable for use as flooring. Each member comprises a male connector and a female connector for releasably connecting the members together along adjacent side edges. Members are connected by inserting the male connector of one member into the end of the female connector of an adjacent member and sliding the male connector lengthwise of the female connector.

A disadvantage of these flooring systems is that access is required to the end of the member with the female connector to connect the male connector of a further member. This can lead to problems if space is. restricted.

SUMMARY OF THE INVENTION

It is an object of the present invention to provide a flooring system that can be assembled in a simple manner.

In a first aspect of the invention there is provided a flooring system comprising a plurality of elongate members releasably attached together by co-operating male and female connector formations extending along side edges of adjacent members, upper surfaces of the members co-operating to provide a support surface, wherein the female connector formations comprise a channel for receiving the male connector formation, the channel having an opening of reduced cross-section relative to a portion of the male connector, and at least a portion of one of the connector formations is capable of elastically deflecting to permit insertion of the male connector formation into the channel through the opening.

By inserting the male connector formation through the opening of the channel of the female connector formation, adjacent members can be secured together without sliding the members longitudinally relative to each other.

Preferably, each member comprises a pair of connector formations. In a preferred arrangement, the pair of connector formations of each member is one male connector and one female connector. In this arrangement, all the members may be identical resulting in a reduction in manufacturing costs and simplified assembly of the flooring system as each member will connect to every other member.

In an alternative arrangement, the connector formations of each member are either male connectors or female connectors. During assembly of a flooring system according to this arrangement, each member has to be attached to a member having a different type (male or female) of connector formations.

The opening of the channel may open to the upper surface of the member. The male connector may comprise a downwardly extending rail that is inserted into the channel of the female connector in a direction perpendicular to the plane of the upper surface.

The channel of the female connector may have a shape complimentary to the shape of the male connector so that the male connector is a close fit in the channel. Preferably, the channels and male connectors have non-circular cross-sections. For example, the cross-sectional shape could by any polygon or an oval. In a preferred arrangement, the channels and male connectors have trapezium cross-sections. In this way, rotation of the male connector in the channel of the female connector is. minimised/prevented, reducing the amount of movement of the assembled flooring system in use.

Preferably, at least a portion of the female connector is capable of elastically deflecting from its original "as formed" position to permit insertion of the male connector into the channel through the opening and assists in retaining the male connector in the channel in an assembled condition of the flooring system by resisting movement of the male connector out through the opening.

The female connector may comprise a base and two side walls extending from the base to define the channel and the opening. The side walls may be relative convergent to define the opening of reduced cross-section. One of the side walls may be capable of elastically deflecting to permit insertion of the male connector through the opening and the side wall returning to its original position when the male connector is received in the channel to assist in retaining the male connector in the channel. In. this way, the side wall acts in the manner of a spring leg.

The male connector may also comprise a base and two side walls. The base of the male connector may be joined to the side walls of the male connector by radiused corners that assist insertion of the male connector into the channel of the female connector. The side walls of each connector may extend at an acute angle from their respective bases. The angle may be the same for both connectors. Preferably, the angle is 75°±1°. It will be understood, however, that the angle may be altered depending on the material used for the member 1 and/or on the dimensions of the member 1, in particular the thickness of the walls. Preferably, when the members are releasably attached together, the upper surfaces of the members that co-operate to form the support surface are planar with each other. The upper surfaces of the members may co-operate to provide a substantially continuous, planar support surface.

The members are preferably formed of plastics and in particular, thermoplastics although other extrudable/mouldable materials may be used such as natural or synthetic rubbers. Thermoplastics are preferred as being capable of elastic deformation to facilitate insertion of the male member while providing the members with the strength, rigidity and flexibility required in use of a flooring system constructed from the members. Suitable thermoplastics include polyvinyl chloride, polyethylene, in particular high density polyethylene, or polypropylene or acetals. The material from which the members are made may be fire resistant or treated to have an increased fire resistance. The material from which the members are made could include other materials to provide any desired properties or characteristics, for example UV inhibitors or pigments.

The pair of connector formations extending along side edges of each member may define a further female connector formation comprising a channel open to the underside of the member. The female connector on the side edge of another member which has been inverted (reversed) to face downwardly can be inserted into this further female connector. In this way, the female connector on the side edge acts like a male connector insertable into the further female connector. As a result, the members can be connected together to provide upwardly and downwardly facing, planar support surfaces.

In a second aspect of the invention there is provided a member for use in a flooring system according to the first aspect of the invention.

In a third aspect of the invention there is provided a method of assembling a flooring system according to the first aspect of the invention comprising the steps of releasably attaching two or more members by inserting the male connector of one member into the channel of the female connector of another member, the direction of insertion being substantially perpendicular to the plane of the upper surface of the another member.

The members may be joined side by side to form a panel with the ends of the members aligned. Adjacent panels may be interlocked by one or more links. The link may be a rod received in aligned openings of members of the two adjacent panels. Alternatively, the link may be a member that has been inverted to face downwardly so that the female connector on the side edge is received in aligned further female connectors of members of the two adjacent panels.

Alternatively, the members may be assembled such that members aligned end to end are interlocked together by releasable attachment to an adjacent member that is offset from each member. In this way, all of the members are interlocked with other members of the flooring system.

The members may be interconnected to provide a flooring system having a planar upper surface. In another arrangement, the flooring system may comprise a first plurality of members orientated to have upwardly facing planar surfaces and a second plurality of members reversed to have downwardly facing planar surfaces, the first and second plurality of members being releasably attached to each other by co-operating connector formations of the first and second plurality of members. In this way, both upwardly and downwardly facing support surfaces are provided such that the assembled flooring system has increased strength and is suitable for use on soft ground.

In a fourth aspect of the invention there is provided a flooring system comprising a plurality of elongate members releasably connected together by co-operating male and female connector formations extending along the side edges of the members, the members having upper surfaces which co-operate to provide a support surface, wherein, the female connector formations comprise a channel for receiving the male connector, the channel having a mouth through which the male connector formation can be inserted in the channel, the mouth opening to the upper surface of the member, and the shape of the channel being complimentary to the shape of the male connector such that rotation of the male connector in the channel is prevented.

In a fifth aspect of the invention there is provided a flooring system comprising interlocking floor panels, the panels being releasably connected to one another along adjacent sides by snap engageable male and female connector members wherein the female connector member comprises a channel extending lengthwise of one floor panel and the male connector member comprises a rail extending lengthwise of the other floor panel, and the channel having an opening through which the rail can be snapped into the channel from above said one floor panel.

By this invention, the rail can be placed over the channel and forced downwards through the opening to snap into the channel. We refer to this method of assembly as "top loading". In this way, a floor of desired size and shape can be assembled by interlocking the appropriate number of panels together. The floor can be dismantled by a reverse procedure in which the rail is lifted upwards out of the channel. One of the channel and rail may be elastically deformable to allow the rail to be snapped into the channel for assembly and removed from the channel for dis-assembly.

Each floor panel may be rectangular with a channel along one side edge and a rail along the other side edge whereby each panel can be releasably connected to adjoining floor panels along both side edges.

BRIEF DESCRIPTION OF THE DRAWINGS

Embodiments of the invention will now be described, by example only, with reference to the following drawings, in which.

DETAILED DESCRIPTION

Figure 1:
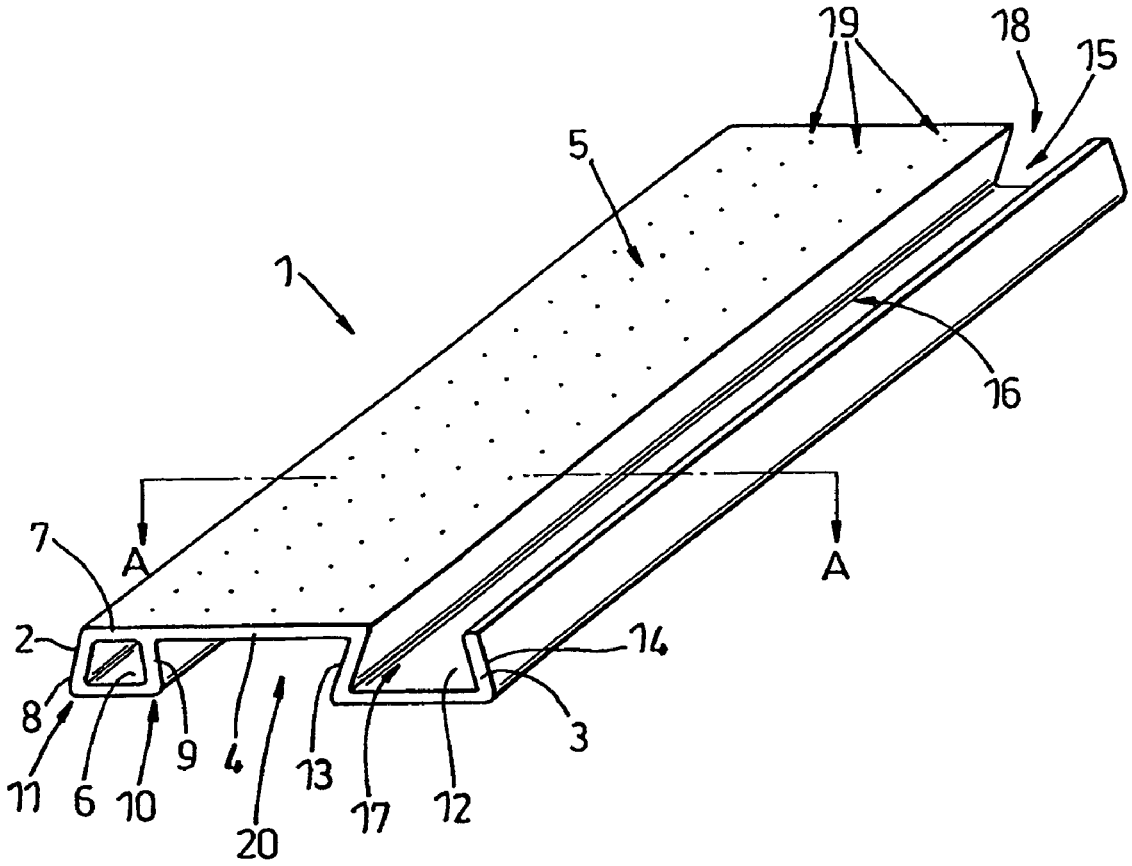
FIG. 1 shows a perspective view of an elongate member for a flooring system according to the invention.
Figure 5:
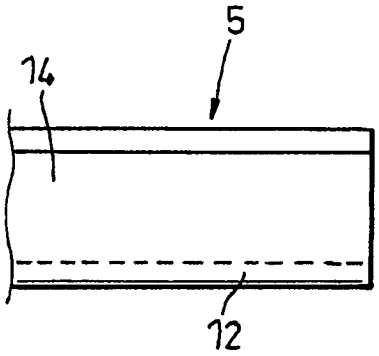
FIG. 5 shows a view of the portion of the member from the other side of the member.

A flooring system according to the invention comprises a plurality of members 1 that can be releasably attached together to form a raised floor.

Referring to FIGS. 1 to 5, a member 1 for a flooring system according to the invention comprises a male connector formation 2 and a female connector formation 3 joined by a central section 4. The connectors 2 and 3 extend along side edges of the member 1. The upper surfaces of the central section 4 and male connector 2 define a support surface 5.

The member 1 is a single component of uniform cross-section extruded from thermoplastics, for example a high-density polyethylene or polypropylene or deformable polyvinyl chloride. The member 1 is formed by cutting an extrusion of the appropriate section to any desired length.

The thermoplastics material of the member 1 provides the member 1 with the required strength and rigidity to withstand the loads applied to the support surface in use without buckling while providing a small degree of flexibility due to the elasticity of the material as described later. In this embodiment, all the walls of the member 1 have a uniform thickness of 5 mm and the top surface 5 has a total width of 10 cm. It will be understood that the dimensions may be altered depending on the materials and intended application of the member 1.

The male connector 2 is a hollow rail of trapezium cross-section having a base 6, an upper portion 7 and two side walls 8 and 9 that join the base 6 to the upper portion 7. The base 6 is wider than the upper portion 7 and the walls 8 and 9 extend at an angle from the base 6 of 75° to the horizontal. Corners 10 and 11 between the base 6 and walls 7 and 8 are radiused. It will be understood, however that the corners 10 and 11 may be unradiused. It will also be understood that the rail can be of solid section and this may be preferred for certain materials such as natural or synthetic rubbers.

The female connector 3 has a base 12 and two relatively converging side walls 13 and 14. Side wall 13 is joined to central section 4 and side wall 14 has a smaller height than side wall 13. The side walls 13 and 14 extend at an angle of 75° to the horizontal from the base 12 to define a dove-tail shaped channel 15 having an opening (mouth) 16 of reduced cross-section. The channel 15 and opening 16 extend along the entire length of the member 1. Openings 17 and 18 are also provided at either end of the member 1.

The side wall 9 of the male connector 2, side wall 13 of the female connector 3 and a lower surface of the central section 4 define a further female connector formation 20 having a mouth of reduced width open to the underside of the member 1.

The upper surface 5 may be knurled, for example with a roller, to provide anti-slip formations 19. It will be understood that other anti-slip formations could be used, for example grooves in the surface 5 or raised areas projecting from the surface 5. Alternatively or additionally, the surface 5 may be provided with an anti-slip material or compound such as a thermoplastic elastomer (TPE) which may be co-extruded with the member 1.

Figure 2:
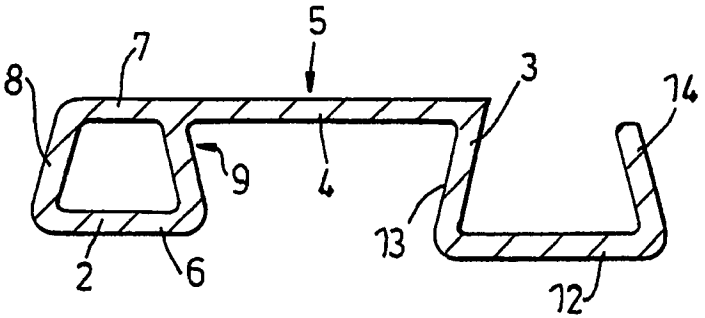
FIG. 2 shows a cross-sectional view of the member along the line A-A of FIG. 1.
Figure 3:
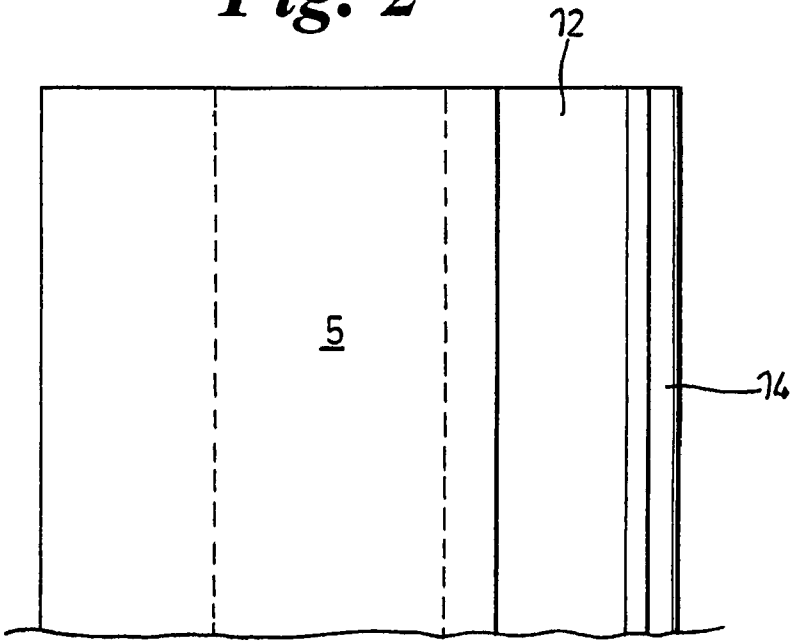
FIG. 3 shows a plan view of a portion of the member of FIG. 1.
Figure 4:
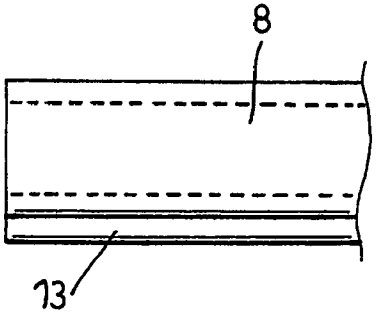
FIG. 4 shows a view of the portion of the member from one side of the member.

The trapezium shape of the male connector 2 is complementary to the dovetailed shape of the channel 15 such that the male connector 2 of another similar member 1 can be received in the channel 15. As best shown in FIG. 2, the height of the male connector 2 is substantially the same as the depth of the channel 15 and the height of the outer wall 14 of the female connector 3 is less than the inner wall 13 by an amount substantially equal to the thickness of the centre section 4. Accordingly, the upper surfaces 5 of adjacent members 1 are substantially co-planar when the male connector 2 of one member 1 is received in the female connector 3 of an adjacent member 1.

The male connector 2 of one member 1 can be inserted in the channel 15 of another member 1 either by sliding the male connector 2 into the channel 15 through one of the openings 17 and 18 or by force-fitting the male connector 2 into the channel 15 from above through the opening 16. To insert the male connector 2 into the channel 15 by force-fitting, the male connector 2 is inserted into the channel 15 in a direction substantially perpendicular to the plane of the upper surface 5. The width of the opening 16 is smaller than the width of the base 6 so that insertion of the male connector 2 into the channel 15 through opening 16 deflects the side wall 14 outwardly to allow the male connector 2 to enter the channel 15. The rounded corners 10, 11 assist insertion of the male connector 2 in the channel 15. In particular, the rounded corners and the elasticity of the sidewall 14 allows the male connector 2 to be snapped into the channel 15. On completion of insertion of the male connector 2 in the channel 15, the sidewall 14 returns towards its original position.

Figure 6:
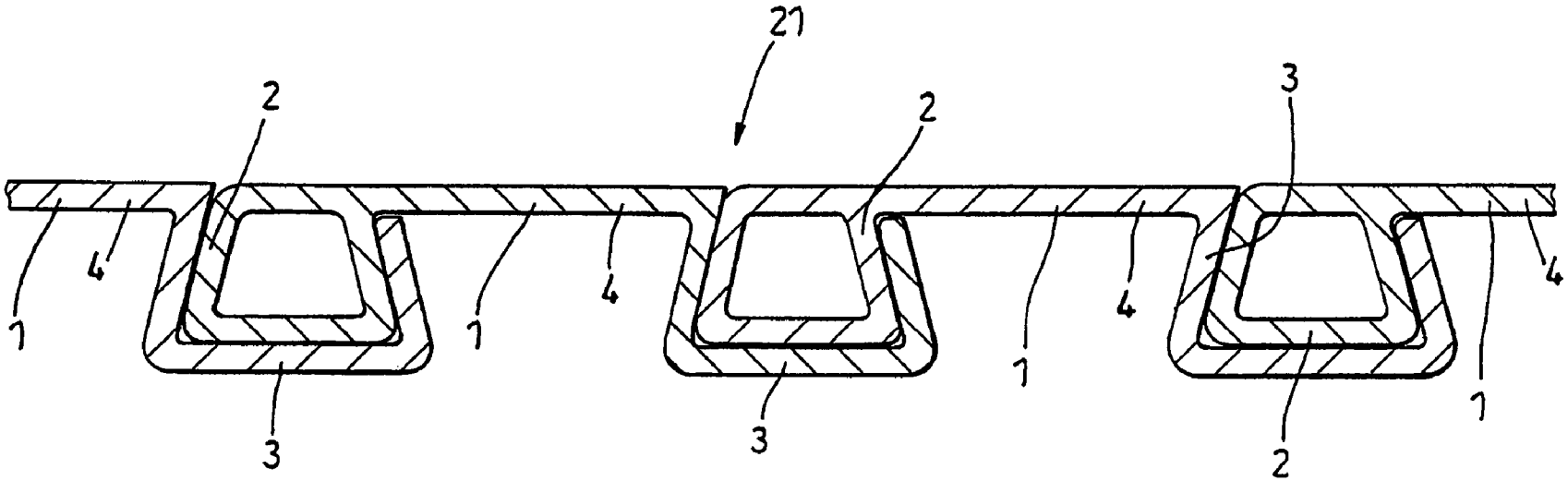
FIG. 6 shows a cross-section of a plurality of members connected together.

A number of members 1 are shown interlocked together in FIG. 6. The male connector 2 of each member 1 is retained in the channel 15 of another adjacent member 1 by the co-operating shape of the connector formations 2 and 3. When assembled together, the upper surfaces 5 of the flooring members 1 co-operate to provide a continuous, planar support surface 21. Movement of the members 1 relative to each other is minimised as the male and female connectors 2 and 3 have non-circular cross-sections preventing rotation of the male connector 2 in the channel 15. In addition, the arrangement of the male and female connectors 2 and 3 is such that downward loads applied to the support surface 21 maintains the engagement of the connectors 2,3.

Similarly to assembly, the members can be disassembled either by sliding the male connector 2 from the channel 15 through openings 17 and 18 or by stripping the male connector 2 from the channel 15 through opening 16 by applying an upwards force to the member 1 at one end sufficient to deflect the sidewall 14 outwardly so that the male connector 2 can pass though the opening.

Figure 7:
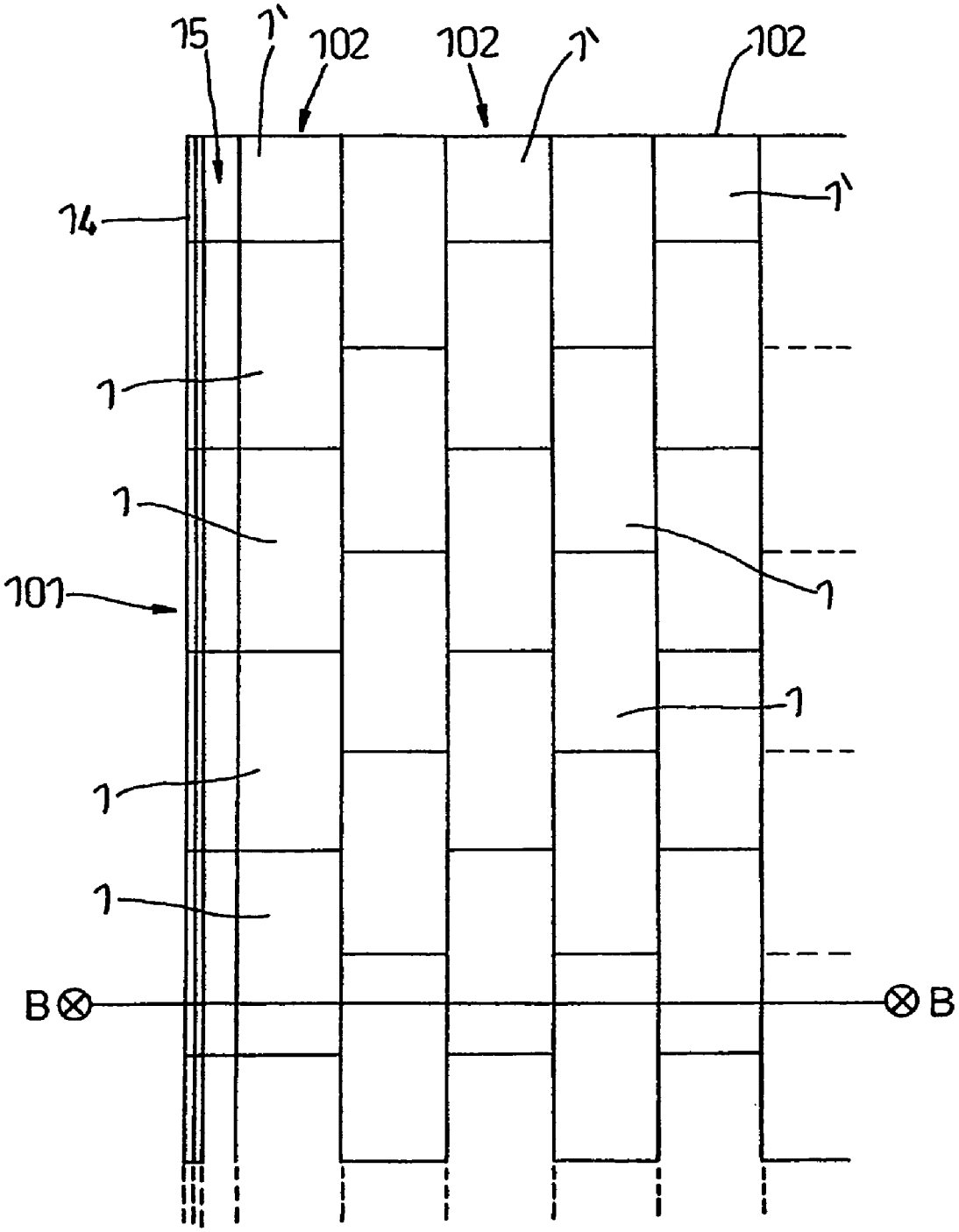
FIG. 7 shows a plan view of a flooring system according to a first embodiment assembled from a plurality of members shown in FIGS. 1 to 5.
Figure 8:
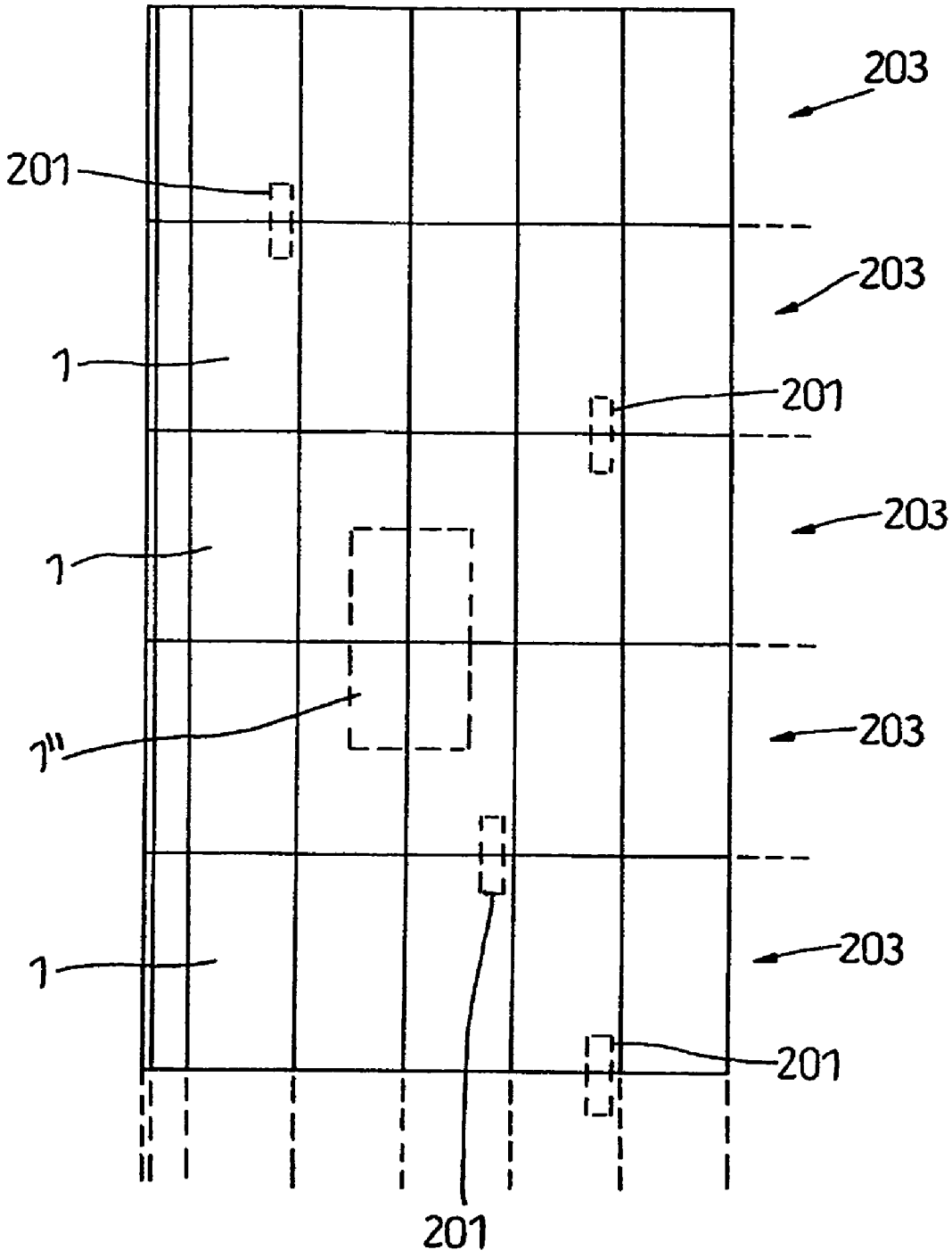
FIG. 8 shows a plan view of the flooring system according to a second embodiment assembled from a plurality of members shown in FIGS. 1-5.

Now referring to FIGS. 7 and 8, two different arrangements for assembling a flooring system comprising a plurality the members 1 to form raised flooring are shown.

In FIG. 7, members 1 are arranged to be aligned end to end and are connected to each other by engagement with adjacent members 1 offset from the members by half the member's length. The members 1' at the edge 102 of the flooring can be cut to length to provide a straight edge finish to the flooring.

In FIG. 8, a plurality of members 1 are releasably connected together with their end faces aligned to form a panel 203.

Two panels 203 may be interlocked together by interlocking rods 201 (shown by the dashed lines in FIG. 8) received in aligned openings in a member of each panel 203 to interlock the panels 203 together. The rods 201 relatively locate panels 203 so that the ends of the members 1 in one panel 203 abut the ends of members 1 in the other panel 203. One or more connecting rods 201 may be used to interconnect the panels 203 together. Usually more than one rod 201 will be used. The connecting rod(s) 201 can be made of any suitable material including plastics and metals.

Alternatively, two panels 203 may be interlocked together by another member 1" (shown by dashed lines in FIG. 8). The member 1" is reversed with its female connector 3 received in the further female connector 20 of two upwardly facing members 1 and its male connector 2 located in a further female connector 20 of another two upwardly facing members 1.

Figure 9:
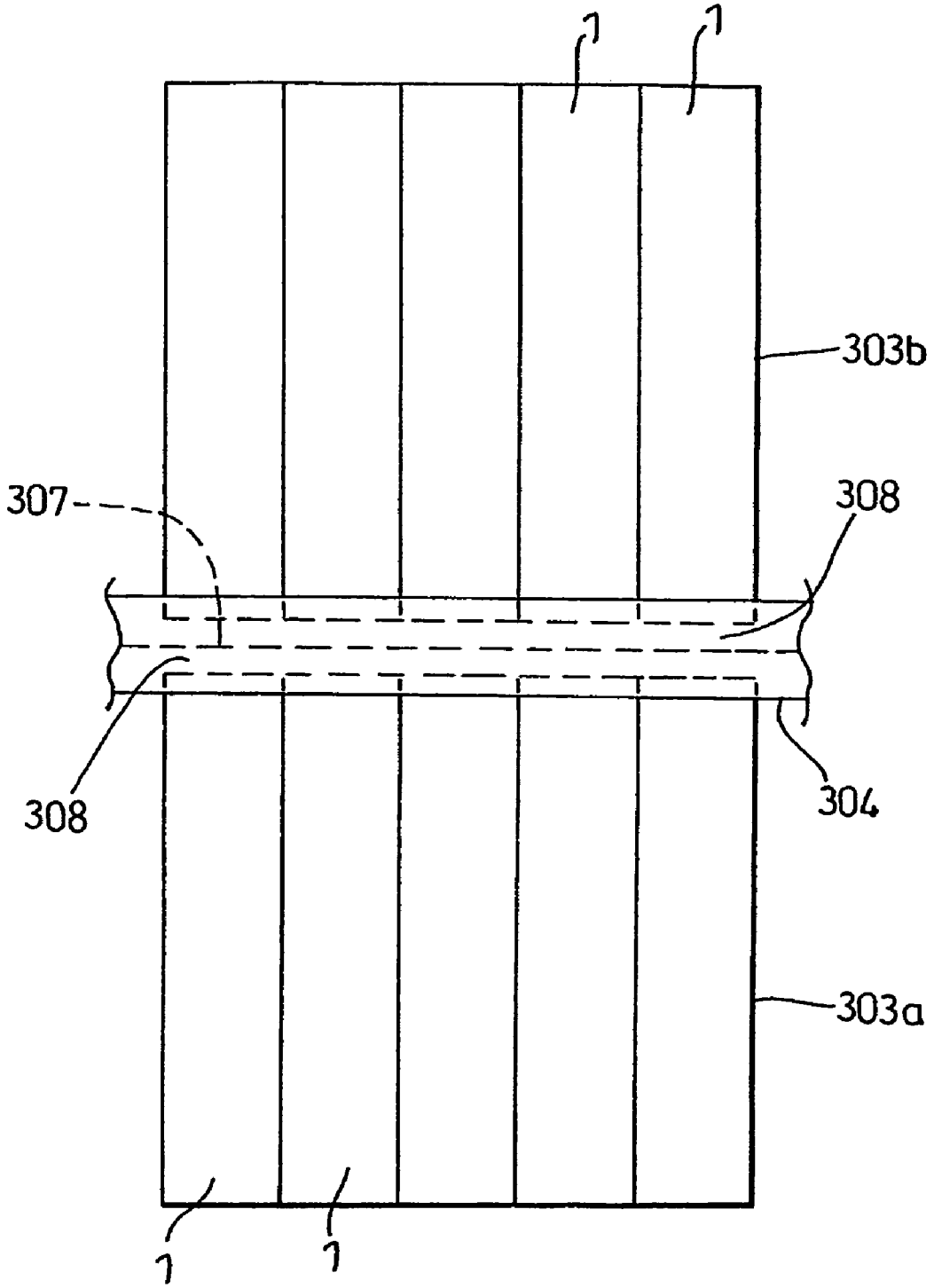
FIG. 9 shows a plan view of the flooring system according to a third embodiment assembled from a plurality of members shown in FIGS. 1 to 5.
Figure 10:
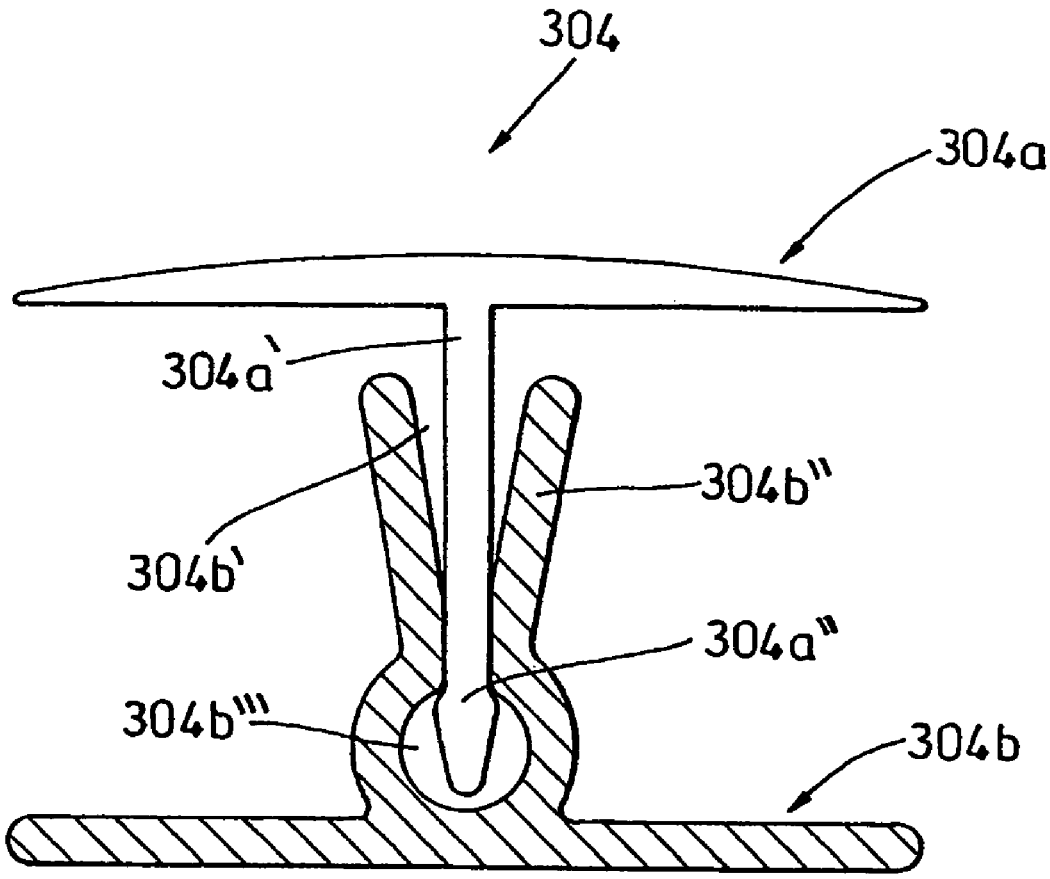
FIG. 10 is an end view, to an enlarged scale, of the connector strip shown in FIG. 9.

Referring now to FIGS. 9 and 10, there is shown another arrangement for assembling a flooring system in which a connector strip 304 is arranged to join two panels 303*a*, 303*b*.

Each panel 303*a*, 303*b* is of rectangular shape made up of a plurality of members 1 releasably connected together. Each member 1 is of uniform length and the panel 303*a*, 303*b* is built to the desired width by joining an appropriate number of members side-by-side. In this embodiment, the members 1 are 5 meters long. This is a convenient length to transport, store and handle but it will be understood this is not essential and the length of the members 1 may be chosen according to the intended application.

The panels 303*a*, 303*b* are laid end-to-end and the connector strip 304 is placed between and covers the adjacent ends of the panels 303*a*, 303*b*. As best shown in FIG. 10, the connector strip 304 comprises a cover member 304*a* and a base member 304*b*.

The cover member 304*a* is of generally T-section with a central, longitudinal flange 304*a*' on the underside terminating in a head 304*a*". The base member 304*b* has a central, longitudinal channel 304*b*' with relatively divergent sidewalls 304*b*" extending from an annular socket 304*b*'".

The cover member 304*a* is releasably connectable to the base member 304*b* by inserting the flange 304*a*' into the channel 304*b*' until the head 304*a*" is received and retained in the socket 304*b*'". The assembly of the cover member 304*a* and base member 304*b* provides a pair of channels 305, 306 separated by a central web 307.

The base member 304*b* may be positioned between the adjacent ends of adjoining panels and the cover member 304*a* secured to the base member 304*b* to overlie and conceal the ends of the panels within the channels 305, 306. Each channel 305, 306 has a depth sufficient to leave a clearance gap 308 between the end of the panel 303*a*, 303*b* and the web 307 such that thermal expansion/contraction of the members 1 can be accommodated without exposing the ends of the panels 303*a*, 303*b* and without the floor buckling. In this way, the connector strip 304 provides a neat finish between adjacent panels 303*a*, 303*b* under all conditions and assists in locating and maintaining the panels 303*a*, 303*b* in the assembled condition.

The cover member 304*a* and base member 304*b* of the connector strip 304 may be made of plastics, for example thermoplastic elastomer similar to the members 1, by extrusion or moulding. Where the members 304*a*, 304*b* are extruded they may be cut to length according to the size of the panels to be connected. The connector strip 304 may extend the full width of the flooring system with one or more panels being received in the channels 305, 306 on each side.

The connector strip 304 or at least the cover member 304*a* may be of same colour as the members 1 or a different colour and may have similar properties, for example fire resistance, UV resistance etc. The web 307 may be adapted to allow air and/or liquid to pass through the web 307 between panels 303*a*, 303*b*. For example, the flange 304*a*' may be provided with apertures (not shown) at spaced intervals along the length. It will be understood that the two-part construction allows the floor to be laid with the base member(s) 304*b* in position and then attaching the cover member(s) 304*a* to conceal the ends of the panel members 1. Also the cover member(s) 304*a* can be detached leaving the base member(s) 304*b* in place if access to any of the panels 1 is required, for example to remove/replace a damaged panel or panel member 1.

It will also be understood that the shape and configuration of the cover member 304*a* and base member 304*b* may be altered as may the releasable connection for securing the members together. In a modification, not shown, the connector strip 304 may be formed in one piece, for example by extrusion.

Figure 11:
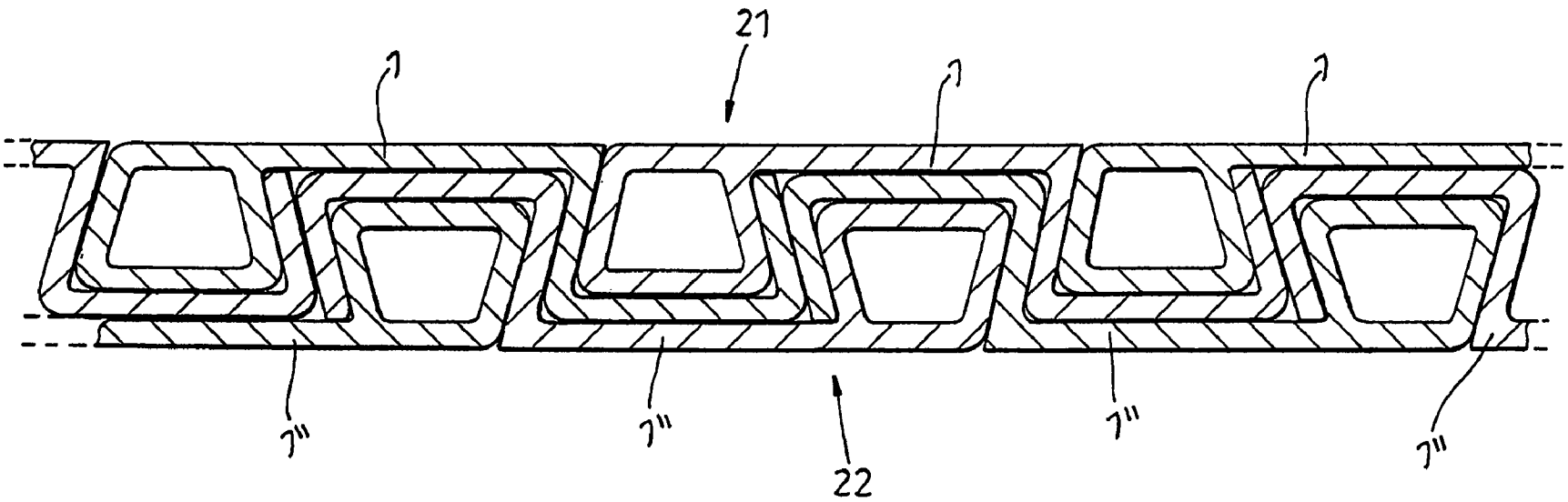
FIG. 11 shows a cross-sectional view of a flooring system according to a fourth embodiment assembled from a plurality of members shown in FIGS. 1 to 5.
Figure 12:
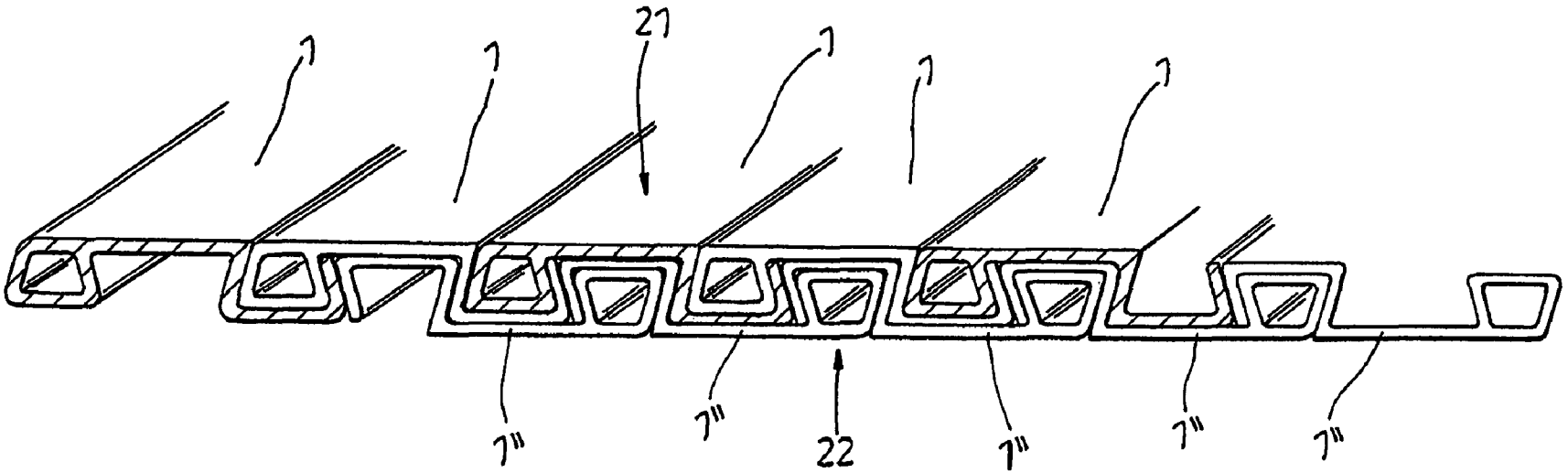
FIG. 12 shows a perspective view of the flooring system of FIG. 11.

Referring now to FIGS. 11 and 12, a flooring system assembled to provide both upwardly and downwardly facing, planar surfaces, is shown. In this arrangement, a plurality of upwardly facing members 1 interlocked together is releasably attached to a plurality of reversed, downwardly facing members 1" interlocked together. The complimentary shape of the members 1, 1" allows the female connector 2 of each member 1 or 1" to be received in the further female connector 20 of an oppositely orientated member 1" or 1 respectively to attach the members 1, 1" together.

Each further female connector 20 of a member 1, 1" receives a side wall 14 of another similarly orientated member 1, 1" and a female connector 3 of a oppositely orientated member 1, 1". The combined cross-sectional width of the female connector 3 and the side wall 14 is larger than the cross-section of the mouth of the further female connector 20. Accordingly, the rigidity of the thermoplastic material that forms the members 1 prevents the female connector 3 and side wall 14 from coming out the female connector 20 during use of the flooring system.

The surface 5 of members 1 provides an upwardly facing planar surface 21 and surface 5 of reversed members 1" provide a downwardly facing surface 22. A flooring system assembled in this manner is particularly suitable for use on soft ground as the loads supported on the flooring are distributed substantially evenly across the soft ground on which the flooring is assembled. A flooring system assembled according to this embodiment has increased strength over other embodiments without significantly increasing the total thickness of the flooring. This flooring system is suitable for supporting heavy loads, such as vehicles. It will be understood that downwardly facing members 1" can also be used in combination with a flooring system assembled according to any of FIGS. 7 to 10.

The flooring system is advantageous as the male connector 2 can be inserted into the channel 15 either through openings 17 and 18 by sliding the connectors 2 and 3 together or by force-fitting the male connector 2 into channel 15 through the opening 16. This simplifies assembly of the flooring system by allowing the members 1 to be attached together from above as well as from the ends. In this way, the flooring can be easily assembled in enclosed spaces where there may not be enough room to attach the members 1 together by slide fitting.

Furthermore, movement of the assembled flooring system is minimised by the rigidity of the members 1, which reduces flexing of the members 1, and the non-circular complimentary shape of the connector members 1, which minimises rotation of the male connector 2 in the channel 15.

Moreover, only a single component having a uniform cross-section throughout its length is required for assembly of a flooring system according to the invention. As a result, manufacture of the member 1 is simple reducing production costs. Also, a plurality of members 1 can be stacked reducing the space required for storage and transportation providing further potential cost and logistical benefits.

Additionally, all the members I are the same and any member 1 can be attached to any other member 1 so that assembly of the flooring system is simplified. In particular, special tools and skills are not required to assemble the flooring system and additional parts may also not be required providing further cost savings.

A further advantage of the flooring system is that it can be assembled in a number of different arrangements. Accordingly, the flooring system can be adapted to many different uses. In particular, because the flooring system can be assembled to have a planar, downwardly facing surface the flooring system is suitable for use on soft ground.

Figure 13:
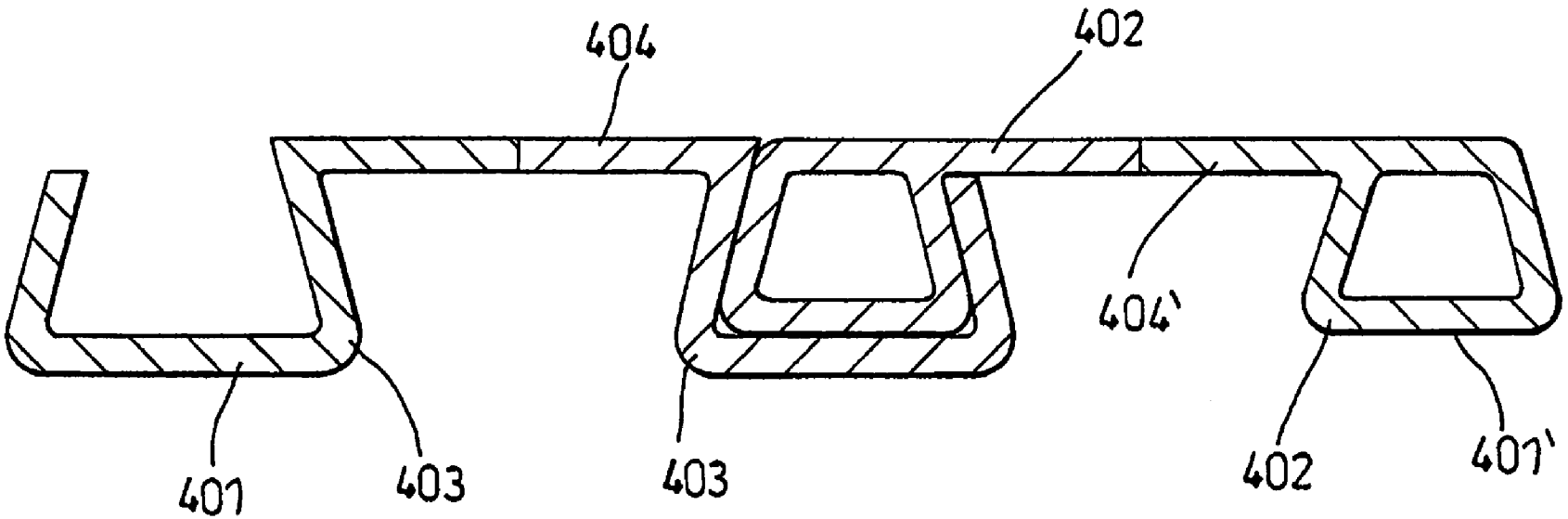
FIG. 13 shows an alternative embodiment of an elongate member for a flooring system according to the invention.

In an alternative embodiment shown in FIG. 13, a flooring system comprises two different members 401, 401', one member 401 having two female connectors 3 and the other member 401' having two male connectors 2. Assembly of the male and female connectors 2, 3 is the same as described above.

It will be apparent to those skilled in the art that the invention is not limited to the embodiments above-described and that various modifications can be made without departing from the concept or principle described herein of a floor system comprising interlocking members releasably connected together by snap fit.

The invention claimed is:

1. A flooring system comprising a plurality of elongate members releasably attached together by co-operating male and female connector formations extending along side edges of adjacent members, upper surfaces of the members co-operating to provide a support surface, wherein the female connector formations comprise a channel having a base and two side walls opening to the upper surface for receiving the male connector formation, the male connector formation having a base and two side walls of complementary shape to the channel, wherein said two side walls of said male connector formation are relatively convergent from said base and said two side walls of said channel are relatively convergent from said base to define a mouth of reduced cross-section relative to said base of the male connector formation, a side wall of the channel is capable of elastically deflecting so that said base and two side walls of the male connector formation can be inserted into the channel through said mouth, and the side wall returning to its original position so that the male connector formation is retained in the channel by the co-operating complementary shape of the base and side walls of said connector formations.

2. The flooring system according to claim 1 wherein, each member has a first edge with a male connector formation and a second edge with a female connector formation.

3. The flooring system according to claim 1 wherein, the male connector comprises a downwardly extending rail that is inserted into the channel of the female connector in a direction perpendicular to the plane of the upper surface.

4. The flooring system according to claim 3 wherein, the channel and rail have complimentary non-circular cross-sections so rotation of the rail in the channel is prevented.

5. The flooring system according to claim 4 wherein, the channel and rail have complimentary trapezium cross-sections.

6. The flooring system according to claim 1 wherein, the male connector comprises said base and two side walls and the base is joined to the side walls by radiused corners that assist insertion of the male connector into the channel of the female connector.

7. The flooring system according to claim 1 wherein, when the members are releasably attached together, the upper surfaces of the members that co-operate to form the support surface are planar with each other and cooperate to provide a substantially continuous, planar support surface.

8. The flooring system according to claim 1 wherein, the members are formed of plastics.

9. The flooring system according to claim 8, wherein the members are made of thermoplastics selected from the group comprising polyethylene, high density polyethylene, polypropylene, deformable polyvinyl chloride and acetals.

10. The flooring system according to claim 1 wherein the members are fire resistant or treated to have an increased fire resistance.

11. The flooring system according to claim 1 wherein each connector member has a pair of connector formations extending along first and second edges that define a further female connector formation comprising a channel open to the underside of the member.

12. The flooring system according to claim 11 wherein, the further female connector can receive the female connector on the side edge of another member which has been inverted so that, when connected, a first plurality of said members provide upwardly facing, planar support surfaces, and a second plurality of said members that have been inverted and connected to said first plurality of said members provide downwardly facing, planar support surfaces.

13. The flooring system according to claim 1 wherein the members have walls of uniform thickness and are of uniform cross-section throughout their length.

14. The flooring system according to claim 1 wherein a plurality of members are releasably connected together side-by-side to form a rectangular panel, and a plurality of panels are arranged end-to-end and/or side-by-side with a connector strip between the ends of adjoining panels to provide an expansion gap such that any change in length of the members due to thermal expansion/contraction can be accommodated.

15. A method of assembling a flooring system comprising the steps of releasably attaching two or more members by male and female connector formations provided along adjoining side edges of adjacent members whereby upper surfaces of the members cooperate to provide support surface defining a plane including the upper surfaces, wherein the female connector formations comprise a channel having a base and two sidewalls that are relatively convergent from the base to define a mouth of reduced cross-section opening to the upper surface for receiving the male connector formation, the male connector formation being of complementary shape to the channel with a base and two side walls that are relatively convergent from the base, said mouth of the channel being of reduced cross-section relative to said base of the male connector formation, and, inserting the base and side walls of the male connector of one of said members into the channel of the female connector of another of said members, the direction of insertion being substantially perpendicular to the plane of the upper surface of the another member wherein a side wall of the channel is capable of elastically deflecting as the base of the male connector formation is being inserted into the channel through the mouth, and the side wall returning to its original position so that the base and side walls of the male connector formation are retained in the channel by the co-operating complementary shape of the connector formations.

16. A method of assembling a flooring system comprising the steps of releasably attaching two or more members by male and female connector formations provided along adjoining side edges of adjacent members whereby upper surfaces of the members co-operate to provide a support surface defining a plane including the upper surfaces, wherein the female connector formations comprise a channel opening to the upper surface for receiving the male connector formation, the male connector formation being of complementary shape to the channel, the channel having a base and two relatively converging side walls that define an opening of reduced cross-section relative to a base of the male connector formation, and, inserting the male connector of one of said members into the channel of the female connector of another of said members, the direction of insertion being substantially perpendicular to the plane of the upper surface of the another member wherein a side wall of the channel is capable of elastically deflecting as the male connector formation is being inserted into the channel through the opening, and the side wall returning to its original position so that the male connector formation is retained in the channel by the c-operating complementary shape of the connector formations wherein, a first plurality of members are assembled to have upwardly facing planar surfaces and a second plurality of members are reversed to have downwardly facing planar surfaces, the first and second plurality of members being releasably attached.

* * * * *